United States Patent [19]

Gibbons

[11] 4,405,110

[45] Sep. 20, 1983

[54] FIXTURE FOR PERFORATED BOARD

[75] Inventor: Alfred M. Gibbons, Dallas, Tex.

[73] Assignee: Kanmark, Inc., Chanute, Kans.

[21] Appl. No.: 352,031

[22] Filed: Feb. 24, 1982

[51] Int. Cl.[3] ..... B61L 5/00

[52] U.S. Cl. ..... 248/221.2; 248/221.3

[58] Field of Search ..... 248/220.3, 220.4, 221.1, 248/221.2, 221.3, 221.4, 222.1; 211/59.1

[56] References Cited

U.S. PATENT DOCUMENTS

| | | | |
|---|---|---|---|
| 1,803,016 | 4/1931 | Harsted . | |
| 2,312,985 | 3/1943 | Bales . | |
| 3,163,132 | 12/1964 | Nelson | 248/221.1 X |
| 3,163,392 | 12/1964 | Husted | 248/221.2 |
| 3,319,917 | 5/1967 | Bilodeau . | |
| 3,452,954 | 7/1969 | Lucietto et al. | 248/221.1 |
| 3,652,032 | 3/1972 | Eros | 248/221.3 X |
| 3,879,006 | 4/1975 | Staudte . | |
| 3,891,172 | 6/1975 | Einhorn . | |
| 3,964,712 | 6/1976 | Staudte . | |
| 3,970,276 | 7/1976 | Debaigt | 248/221.3 |
| 3,985,325 | 10/1976 | Ginsburg et al. . | |
| 4,020,951 | 5/1977 | Wurthner | 248/222.1 X |

FOREIGN PATENT DOCUMENTS

| | | | |
|---|---|---|---|
| 2412781 | 12/1977 | France | 248/220.3 |

*Primary Examiner*—J. Franklin Foss

*Attorney, Agent, or Firm*—Harvey B. Jacobson

[57] ABSTRACT

A supporting bracket for supporting a hanger structure from a perforated panel known as "pegboard" in which the bracket or fixture is molded from plastic material with the rear surface thereof having a pair of rearwardly extending lugs or hooks received in adjacent vertically aligned holes in the panel and the body portion of the bracket including a reduced area portion to enable the lower portion of the bracket with the lower lug or hook thereon to be flexed inwardly or outwardly to enable assembly and disassembly of the bracket or fixture with respect to the perforated panel. The bracket also includes a structure to support a wire hanger or the like projecting laterally therefrom. The bracket also includes laterally extending flanges thereon for engaging the forward surface of the perforated panel to stabilize the bracket or fixture and the structure of the lugs or hooks is such that a gripping force is exerted forwardly by the lugs or hooks against the rear surface of the perforated panel to retain the rearwardly facing surfaces of the bracket firmly against the forward face of the perforated panel.

9 Claims, 3 Drawing Figures

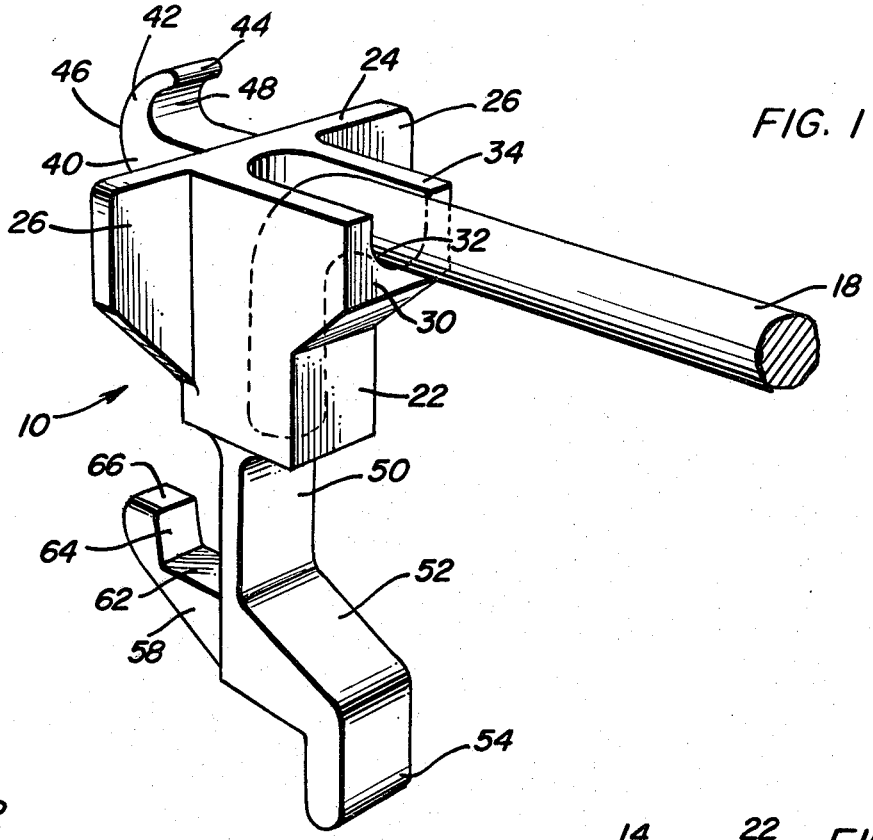
FIG. 1
FIG. 2
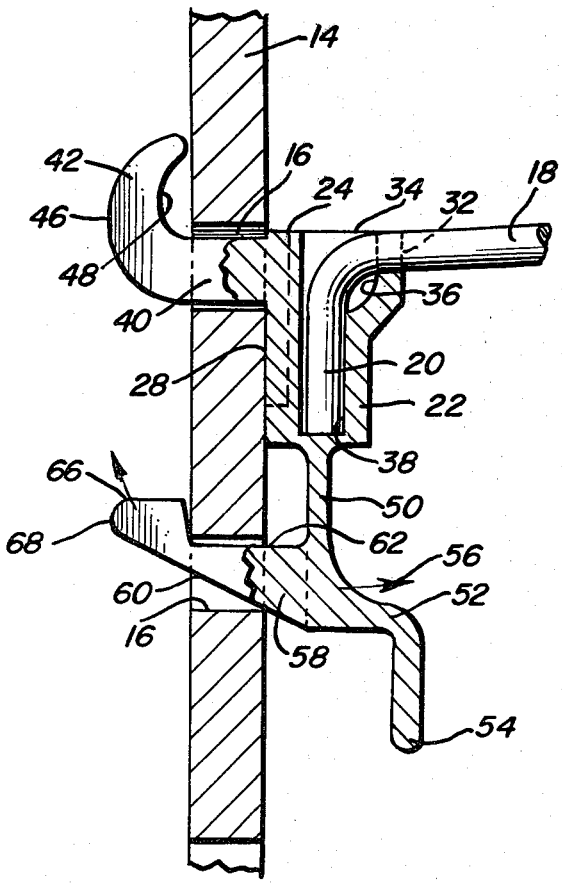
FIG. 3
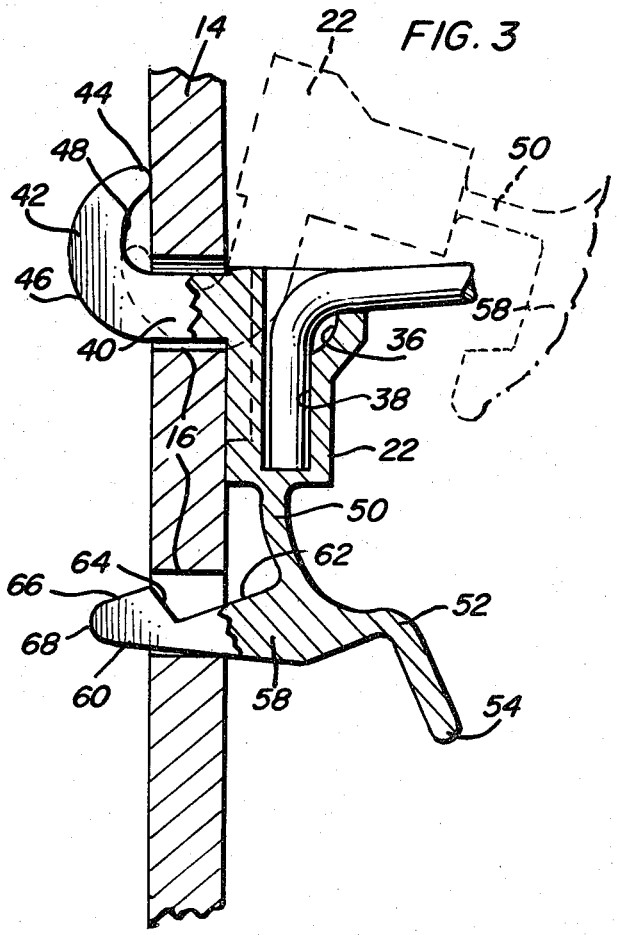

FIXTURE FOR PERFORATED BOARD

BACKGROUND OF THE INVENTION

1. Field of the Invention

The present invention generally relates to a support bracket or fixture mountable on a perforated panel, such as "pegboard", with the bracket or fixture supporting a hanger in order to support an article or articles from the panel.

2. Description of the Prior Art

Perforated panels, such as "pegboard", are usually manufactured in two standard sizes in which the thickness of the panel may be either ¼ inch for heavy-duty, industrial or commercial use, or ⅛ inch used for light-duty purposes. The ¼ inch panel has holes or apertures approximately ¼ inch in diameter and the ⅛ inch thick panel has holes approximately ⅛ inch in diameter and both types of panels have the holes or apertures arranged on one inch centers in vertical and horizontal rows. Various types of hangers of wire and other material have been provided for attachment to the panels when the panels are vertically disposed with such hangers including generally horizontally disposed rod-like structures and the like for supporting a plurality of articles thereon. While such brackets perform satisfactorily during certain types of use, they often times separate from the panels when items hung therefrom are being removed. Some efforts have been made to provide a positive connection between the brackets and panels, such as by using screw threaded elements, and the like. The following U.S. patents are exemplary of the developments in this field of endeavor.

U.S. Pat. No. 1,803,016—Apr. 28, 1931
U.S. Pat. No. 2,312,985—Mar. 2, 1943
U.S. Pat. No. 3,163,392—Dec. 29, 1964
U.S. Pat. No. 3,319,917—May 16, 1967
U.S. Pat. No. 3,452,945—July 1, 1969
U.S. Pat. No. 3,879,006—Apr. 22, 1975
U.S. Pat. No. 3,891,172—June 24, 1975
U.S. Pat. No. 3,964,712—June, 22, 1976
U.S. Pat. No. 3,985,325—Oct. 12, 1976.

SUMMARY OF THE INVENTION

An object of the present invention is to provide a bracket or fixture for supporting a hanger from a vertically disposed perforated panel which is molded of plastic material having a structure to engage and support the hanger and including a pair of vertically disposed and aligned rearwardly extending lugs or hooks insertable through vertically aligned apertures in the perforated panel with the bracket including a reduced cross-sectional area portion between the two lugs or hooks to enable flexing of the bracket to pivotally swing the lugs or hooks in relation to each other to facilitate assembly of the bracket onto the panel and removal of the bracket from the panel.

Another object of the invention is to provide a bracket, in accordance with the preceding object, in which the bracket includes a body having laterally extending flanges with relative large surface areas facing and engaging the front surface of the panel and the rearwardly projecting hooks or lugs including surface areas engaging the rearward surface of the panel in opposed relation to the rearwardly facing surfaces on the bracket which engage the panel, thereby securely mounting the bracket to the panel.

A further object of the invention is to provide a bracket, in accordance with the preceding objects, in which the bracket body includes a vertically disposed socket and a pair of upstanding flanges alongside thereof to receive and orient a conventional wire rod hanger which is horizontally disposed and provided with a downturned end portion rceived in the socket in the bracket body.

Still another object of the invention is to provide a bracket, in accordance with the preceding objects, in which the lower end of the bracket is provided with an actuating or handle member offset from the panel to enable it to be easily grasped to flex the body of the bracket to facilitate entry of the lower hook or lug into the hole in the perforated panel and also removal thereof when desired.

A still further object of the invention is to provide a bracket or fixture for supporting a conventional article support or hanger from a perforated panel, such as a "pegboard", which is relatively simple in construction and constructed of one-piece material, thereby eliminating the use of separate fasteners, and the like, with the bracket having sufficient strength and rigidity to support considerable weight, securely retained on the perforated panel and easily assembled and disassembled in relation thereto.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the bracket or fixture of the present invention illustrating a rod-type hanger supported thereby.

FIG. 2 is a side elevational view of the bracket with portions thereof being in section and illustrating the association of the bracket with the perforated panel and hanger when the components are assembled.

FIG. 3 is a view similar to FIG. 2 but illustrating the steps in assembling and disassembling the bracket in relation to the perforated panel.

DESCRIPTION OF THE PREFERRED EMBODIMENT

The bracket or fixture of the present invention is generally designated by the numeral 10 and is associated with a vertical panel 14 having apertures or holes 16 provided therein in a regular pattern. Panels 14 of this type are well known and generally referred to as "pegboard" with the holes 16 being arranged on one inch centers in vertically and horizontally aligned rows. The bracket 10 supports a horizontally disposed hanger 18 in the form of a wire rod, or the like, with the outer end thereof slightly inclined upwardly in a conventional manner by which a plurality of articles may be supported by inserting the free end of the rod-like hanger 18 through corresponding apertures in the articles being supported. The end of the rod 18 engaging the bracket 10 is downturned at right angles, as indicated by numeral 20, with it being pointed out that the hanger 18 is conventional and forms no particular part of the present invention, except for its association with the bracket, and the panel and holes 14 and 16 are also conventional and form no particular part of this invention except for their association with the bracket 10.

The bracket or fixture 10 includes a body 22 which is generally rectangular in construction and provided with a substantially flat or planar upper surface 24. The two side edges of the body 22 have a laterally extending flange 26 integral therewith with the flanges 26 being in alignment with each other and in alignment with the rear surface of the body 22 thereby providing a relatively large, flat rear surface 28 on the body 22 to increase the surface area of the panel 14 which is contacted or engaged by the body 22. The outer surface of the body 22 is provided with a forwardly extending projection 30 at its upper edge having a U-shaped recess or trough 32 formed therein which defines a pair of generally parallel flanges 34 that are spaced apart sufficiently to closely receive the hanger rod 18. The inner portion of the trough 32 is enlarged somewhat as indicated at 36 and this area communicates with a vertical socket 38 which receives the downturned end 20 of the hanger 18.

The flat rear surface 28 of the body 22 is provided with a rearwardly extending lug or hook 40 having a terminal hook-shaped end portion 42 which curves upwardly and forwardly to a rounded end edge 44 which may be substantially semi-cylindrical in constructon and having a length equal to the width of the hook or lug 40, so that the entire structure of the hook or lug will be the same width throughout its length and height. The hook-shaped or forwardly curved portion 42 slightly reduces in thickness as it curves with the radius of curvature of the surface 46 being different from the radius of curvature of the surface 48, thus providing a relieved area to enable the curved portion 42 to be inserted through the hole 16 by orienting the body initially in a generally perpendicular relation to the panel, as illustrated in broken lines in FIG. 3, with the body 22 then being moved downwardly and pivoted as the curved end portion 42 of the hook or lug 40 is moved through the hole 16 toward its final position, as illustrated in full lines in FIG. 3.

The central portion of the bottom of the body 22 is provided with a depending web 50 of reduced cross-sectional dimensions as compared to the body 22. The lower end of the web 50 includes a laterally extending right angular portion 52 which is offset away from the panel 14 to facilitate gripping engagement with the depending handle 54, so that the web 50 can be flexed in either direction as illustrated in FIG. 3 and as indicated by the arcuate arrow 56. Extending toward the panel from the lower end of the web 50 is a hook or lug 58 having an inclined bottom surface 60 and an upper surface portion 62 perpendicular to the web with the lower surface 60 and the upper surface 62 converging away from the web. The hook or lug 58 is provided with an upstanding surface 64 generally perpendicular to the surface 62 and communicating with the outer end of the surface 62. The upstanding surface 64 terminates at a generally horizontally disposed outer top edge portion 66 that is generally parallel to but offset above the surface 62 with the surfaces 60 and 66 merging and connecting at a rounded nose portion 68. When the handle 54 is gripped and pivoted, the lug 58 will swing in an arcuate path as defined by the arcuate line 56 as the web 50 flexes. The entire body, including the web and handle portion, is constructed of suitable plastic material, such as "Delrin", so that the web is capable of a large number of flexings without failure.

In order to mount one of the brackets to its corresponding size of "pegboard", the end portion 44 and adjacent curved portion 42 is inserted into the hole with the entire bracket being pushed inwardly and downwardly so that the top lug 40 fully engages the selected hole 16. By bending the lower portion of the handle 54 outwardly away from the panel, the bottom lug 58 can be inserted into another hole 16 below the hole which receives the top lug or hook 40 and the flat surface 64 will bear firmly against the back of the "pegboard" with the surface 64 being slightly upwardly inclined so that it, in effect, forms a camming engagement with the upper edge of the hole 16 to pull the body of the bracket inwardly toward the panel 14. The rounded, forwardly facing edge 44 of the upper lug 40 also bears firmly against the inner surface of the panel so that the configurations of the top lug 40 and the bottom lug 58 and the flanges 26 coact to provide and exert a firm holding pressure with the bracket engaging the front of the panel over a relatively large surface area and providing forward force or pressure against the rear surface of the panel, thereby preventing side-to-side shifting and tilting and stabilizing the bracket in relation to the panel. The curved portion 42 and its tapering thickness and flexibility combined with the flexibility of the web 50 compensate for varying thicknesses found among standard available perforated panels from different manufacturers. With the bracket firmly mounted, any one of numerous wire hangers 18 can be quickly and easily inserted into the socket provided therefor in the bracket, with it being pointed out that other types of connections may be provided between the hanger or support structure and the bracket. In order to relocate the assembly after it has been mounted, the wire hanger 18 is first removed from the bracket and then the lower extremity of the handle 54 is grasped between the thumb and forefinger and pulled outwardly, thus bending the web 50 toward the front, thus forcing the bottom lug 58 to rotate downwardly so that it exits from its hole 16. An upward and outward rotation of the bracket then withdraws the top lug 40 from its hole.

The one-piece construction of the bracket eliminates possible loss of extraneous fastening devices, rotatable elements or other complex structures involving multiple components and the structure of the bracket provides sufficient strength and rigidity for supporting those weights capable of being supported by the panel 14. The structure of the bracket and its gripping engagement with both front and rear surfaces of the panel provides a stable arrangement which will not pivot or slide from side-to-side, but yet which can be easily relocated when desired without requiring any tools whatsoever. By molding the device of conventional plastic material, the over-all cost of the device may be maintained at a minimum in order to render the bracket economically feasible.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bracket for supporting an article hanger from a perforated panel having vertically spaced and aligned apertures, said bracket comprising a body of unitary construction of plastic material have resilient characteristics, said body having a rear surface engageable with the panel, a top lug projecting from the rear face of the body and extendible through an aperture in the panel, a bottom lug aligned with the top lug and projecting from the body and extendible through a lower aperture in the panel, at least one of said lugs including means engaging the rear surface of the panel and exerting a forward gripping force thereon to securely mount the bracket on the panel, said body including a flexible resilient web portion supporting the bottom lug to enable arcuate swinging movement thereof to facilitate insertion of and removal of the bottom lug in relation to the lower aperture.

2. The bracket as defined in claim 1 wherein said top lug includes a straight portion perpendicular to the rear face of the body and an upwardly extending and reversely curved terminal end portion terminating in a forwardly facing edge portion forming the means engaging the rear surface of the panel.

3. The bracket as defined in claim 1 wherein said bottom lug includes a tapering portion projecting from the web and having a straight upper surface portion perpendicular to the rear face of the body when the web is straight, the end of bottom lug remote from the web including an upwardly projecting portion having a forwardly facing surface continuous with the outer end of the straight upper surface and forming the means engaging the rear surface of the panel.

4. The bracket as defined in claim 1 wherein said bottom lug includes a forwardly offset and depending handle thereon to enable forward force to be exerted on the bottom lug and the lower end of the web portion to bend the web and swing the bottom lug in an arcuate path to enable it to pass through the lower aperture.

5. The structure as defined in claim 1 wherein said top lug is hook-shaped in configuration and includes a tapering reversely curved portion having a rounded terminal edge extending toward the rear surface of the panel and forming part of the means engaging the rear surface of the panel, said bottom lug including a recess in its upper surface defined by an inclined surface engaging the upper rear portion of the lower aperture and the adjacent rear surface of the panel forming the remainder of the means engaging the rear surface of the panel and exerting a forward gripping force thereon with the resiliency of the web portion biasing the bottom lug upwardly whereby the inclined surface of the bottom lug will cam the rear surface of the body toward the front surface of the panel.

6. The structure as defined in claim 5 wherein the lower end of the web portion includes a projecting handle extending in an opposite direction from the bottom lug to facilitate flexing of the web portion to orient the bottom lug in alignment with the lower aperture during insertion of the bottom lug through the lower aperture and removal of the bottom lug through the lower aperture, said inclined surface on the bottom lug enabling forward force to be exerted on the rear surface of panels of standard thickness and production variations thereof.

7. The structure as defined in claim 6 wherein said bracket includes a vertically disposed socket communicating with the upper surface thereof, laterally extending notch means in the body in communication with the upper end of the socket to receive an article hanger in the form of a rod-like structure having a horizontal component and a vertical component with the vertical component being received in the socket and the horizontal component received in the notch means thereby stabilizing the article hanger, said socket terminating above the flexible web portion of the body, said body including laterally extending flanges above the flexible web portion with the rear surface of the flanges being coplanar with the rear surface of the body to engage a larger lateral area of the front surface of the panel to stabilize the bracket in relation to the panel.

8. A support for engagement with a perforated panel having spaced and aligned apertures including a body having a substantially flat rear surface area engaging the front surface of the panel adjacent one of the apertures, a hook-shaped lug projecting from the flat rear surface of the body and extending through one of the apertures in the panel and terminating in a laterally extending and reversely curved terminal end portion for engaging the rear surface of the panel in spaced relation to the aperture through which the lug extends, said body including a flexible web portion extending from the body in generally parallel relation to the flat surface of the body in spaced relation to the front surface of the panel to enable the web portion to flex in either direction with the web portion having resilient characteristics for return to a normal position substantially parallel with the surface of the body which engages the front of the panel, the outer end of the flexible web portion including a projecting lug extending laterally therefrom through the other aperture in the panel, said projecting lug including a recess in the surface thereof facing the hook-shaped lug with the recess terminating in an inclined surface extending toward the hook-shaped lug and being inclined away from the flat surface of the body to cammingly engage the rear surface of the panel and exerting a forward force against the rear surface of the panel in spaced relation to the free edge of the hook-shaped lug thereby retaining the body securely against the panel.

9. The support as defined in claim 8 wherein the free edge of the hook-shaped lug is spaced laterally in relation to the flat surface of the body and the inclined surface on the projecting lug is spaced laterally from the flat surface of the body, thereby providing a stabilizing and securing force for the body at laterally spaced points in relation to the area of the panel engaged by the flat surface of the body.

* * * * *